US005675703A

United States Patent [19]

Sato

[11] Patent Number: 5,675,703

[45] Date of Patent: Oct. 7, 1997

[54] APPARATUS FOR DECODING COMPRESSED AND CODED SOUND SIGNAL

[75] Inventor: Hirofumi Sato, Tokyo, Japan

[73] Assignee: Nippon Steel Corporation, Tokyo, Japan

[21] Appl. No.: 420,156

[22] Filed: Apr. 11, 1995

[30] Foreign Application Priority Data

Apr. 12, 1994 [JP] Japan ..... 6-098156

[51] Int. Cl.[6] ..... G10L 9/00

[52] U.S. Cl. ..... 395/2.39; 395/2.67; 395/2.92; 395/2.95; 375/240; 370/477

[58] Field of Search ..... 395/2.33, 2.38, 395/2.39, 2.67, 2.75, 2.76, 2.77, 2.78, 2.91, 2.92, 2.94, 2.95; 375/240; 370/118, 477

[56] References Cited

U.S. PATENT DOCUMENTS 5,461,378 10/1995 Shimoyoshi et al. ..... 341/51
5,508,949 4/1996 Konstantinides ..... 364/725
5,511,094 4/1996 Lee et al. ..... 375/243

FOREIGN PATENT DOCUMENTS 5-218771 12/1993 Japan ..... H03G 7/00

OTHER PUBLICATIONS

"Outline of MREG Standard" Jun Yonemitsu Technology, Dec. 21, 1993, pp. 11–27.

"Audio Decoder Functional Overview", Chapter 2 of LSI Logic L6411 Technical Manual, pp. 2–1 thru 2–8 Sep. 1993.

Iwadare, M. et al., "A Single–Chip MPEG/Audio Decoder LSI Based on a Compact Decoding Algorithm", VLSI Signal Processing, VIII, pp. 118–125 Sep. 1995.

*Primary Examiner*—Russell W. Blum
*Attorney, Agent, or Firm*—Pollock, Vande Sande & Priddy

[57] ABSTRACT

An apparatus for decoding a compressed and coded sound signal by applying thereto an inverse quantization processing and a synthesis processing is arranged to include a data extracting unit for extracting quantization level data, scale factor data and quantization data from a data stream of the compressed and coded sound signal, and an integrated processing unit for processing the extracted data by use of an integrated operational equation which is obtained by combining a first operational equation used for the inverse quantization processing with a second operational equation used for the synthesis processing.

3 Claims, 5 Drawing Sheets

PRIOR ART

APPARATUS FOR DECODING COMPRESSED AND CODED SOUND SIGNAL

BACKGROUND OF THE INVENTION

1. Field of the Invention

The present invention relates to an apparatus for decoding a compressed and coded sound signal, and more particularly to an apparatus for decoding a compressed and coded sound signal in accordance with the MPEG standard.

2. Description of the Related Art

In recent years, a technique called MPEG has been developed as one of compression techniques for digital sound signal. This technique based on MPEG has been standardized by the ISO/IEC (International Organization for Standardization and International Electrotechnical Commission) 11172 and includes both MPEG 1 and MPEG 2 which are collectively called MPEG standard.

As disclosed in "Outline of MPEG standard" by Jun Yonemitsu, MPEG Technology, Dec. 21, 1993, pp. 11~27, the MPEG standard includes three systems or layers 1, 2 and 3 provided in accordance with required tone quality and circuit scale. A main difference between the layers 1 and 2 is a difference in packet size, i.e. as to how many digitized information data subjected to coding and sampling are collectively packed. The layer 3 includes a difference in coding system in addition to the difference in packet size.

Also, the MPEG standard prescribes channel modes of sound signal which include a single-channel mode, a dual-channel mode, a stereophonic mode and a joint-stereophonic mode. A difference between these modes includes a difference in the number of sound sources as to one or two (or stereophonic) and a difference in coding method of stereophonic sound in a high-pitched sound region.

In the MPEG standard, the transmission rates to be used are prescribed for the respective channel modes of each layer. For example, the transmission rate values of 32, 64, 96, 128 and 160 Kbit/sec are defined for the single-channel mode of the layer 1. A difference in transmission rate has influence on the amount of data after compression. Also, three kinds of rates of 32, 44.1 and 48 KHz are prescribed as the output rate (or sampling rate) of a sound signal after reproduction.

The principle of compression and decoding of a sound signal employed in the MPEG standard will now be explained by way of example in conjunction with the case where a sound signal of one frame is compressed and decoded under the conditions of layer 1, the single-channel mode, the transmission rate of 128 Kbit/sec and the sampling rate of 48 KHz.

In general, the frequency of a sound signal falls in a specific frequency range. Therefore, when the frequency range or band is divided into 32 frequency sub-bands, the frequency of a sound signal included in each sample is included in any one or ones of the 32 sub-bands. First, 512 samples of a first block are obtained from the sound signal at the sampling rate of 48 KHz. On the basis of the 512 samples of the first block are derived the amplitudes of those frequency components of the corresponding sound signal which belong to the 32 sub-bands, respectively. The derived amplitudes are used as sample data of the sound signal in the first block referring to the 32 sub-bands. Next, 512 samples delayed from the 512 samples of the first block by 32 samples are taken as a second block and the sample data of the corresponding sound signal referring to the 32 sub-bands are derived on the basis of the 512 samples of the second block in a manner similar to that for the first block. Thus, the sample data referring to the 32 sub-bands are successively determined for 12 blocks of the first to twelfth blocks, each including 512 samples and delayed successively by 32 samples, thereby obtaining sample data of one frame which includes 12 sample data for each of the 32 sub-bands.

Next, 12 sample data obtained for each of the 32 sub-bands are quantized or digitized. In order to digitize a sound signal with as high a fidelity as possible, it is suitable to increase the number of bits of a digital signal representing the level of each sample data. However, for the requirements of making a used memory capacity as small as possible, it is not allowable to allot a sufficient number of bits to all sample data since the maximum total number of bits used for one frame is determined from the above-mentioned transmission rate and sampling rate. In order to represent each sample data at a high accuracy with a smaller number of bits, a scale factor (SF) and a quantization level (Allocation) are determined. In the MPEG standard, 12 sample data belonging to the same one of 32 sub-bands included in one frame are allotted with the same scale factor and the same quantization level. Therefore, the maximum amplitude of 12 sample data included in each sub-band is determined and the 12 sample data are normalized with reference to the determined maximum amplitude. The scale factor of each sub-band is determined on the basis of the maximum amplitude and the allocation of each sub-band is determined by considering the total number of bits which are allowed to be used for one frame.

The quantization level (Allocation) is set for each sub-band on the basis of the minimum lower limit audition characteristic and the masking characteristic in a human audio psychology model so as to be in coincidence with the allowable total number of bits for one frame. The minimum lower limit audition characteristic is such that the human's auditory sense is relatively poor in low and high frequency regions. The masking characteristic is such that the auditory sense becomes lower at frequencies in the vicinity of the peak of a specific frequency spectrum.

Next, the normalized samples for each sub-band are quantized and coded in accordance with the set quantization level (Allocation) to determine quantization data (Sample). The quantization data (Sample) are set into one data stream together with the scale factors (SF) and the quantization levels (Allocation) to generate a compressed sound signal.

The thus compressed and coded sound signal is transmitted as a data stream of units each constituting one frame. FIG. 3 shows an example of the format of one frame of the data stream. In FIG. 3, a data stream for one frame includes a header portion 50 representing the leading end of each frame, an Allocation portion 52 representing a quantization level allotted to each sub-band included in that frame, a Scale Factor portion 54 representing a scale factor allotted to each sub-band, a data portion 56 representing quantization data corresponding to the normalized values of 12 sample data included in each sub-band, and a portion 58 representing necessary information which is irrelevant to the present invention.

The quantization level (Allocation) is used when an inverse quantizing operation is performed at the decoding. The quantization level (Allocation) represents the number of bits allotted to each sample included in one sub-band. In the layer 1, four (4) bits are given as the quantization level for each sub-band in one frame. Accordingly, the number of bits for quantization level (Allocation) per one frame amounts to 128 bits which correspond to 32 (sub-bands)×4 bits.

The scale factor (SF) is used when an inverse scaling operation is performed at the decoding. The scale factor (SF) provides an approximate output level. The scale factor (SF) corresponds to, for example, the characteristic part of a floating point number used in a computer. In the layer 1, the scale factor (SF) is omitted in the case where the value of quantization data (Sample) is 0. However, in the case where the scale factor (SF) is not omitted, 6 bits are given as the scale factor for each sub-band in one frame. Accordingly, the number of bits for scale factor (SF) per one frame amounts to 192 bits which correspond to 32 (sub-bands)×6 bits.

The quantization data (Sample) is used when the inverse quantizing operation is performed at the decoding. The quantization data (Sample) provides the detailed value of output data. The quantization data (Sample) corresponds to, for example, the fixed-point part of a floating point number used in a computer. The quantization data (Sample) is represented by the number of bits designated by the quantization level (Allocation) for each frame and the total bits for one frame are about 1 Kbits in the case of layer 1.

The decoding of the compressed data is made by an operation inverse to the compression. Namely, a data stream of compressed sound signal to be decoded is first separated to extract the quantization level (Allocation), the scale factor (SF) and the quantization data (Sample) therefrom. The extracted quantization data (Sample) is subjected to an inverse quantizing operation by the quantization level (Allocation) and to an inverse scaling process by the scale factor (SF) so that sub-band information is obtained.

Next, the sub-band information obtained by the inverse quantizing operation is subjected to a synthesis processing. By applying to successive sub-band information a predetermined processing using a polyphase filter, successive 16 waveforms are obtained. These 16 waveforms are synthesized and the synthesized waveform information is outputted as a decoded sound signal.

More particularly, sample data in one frame are data obtained on the basis of samples of 12 blocks and one set of sample data referring to 32 sub-bands are obtained for each block, as mentioned above. Also, two adjacent blocks are shifted from each other by 32 samples which correspond to one of 16 sections into which the 512 samples of one block are divided. Accordingly, one set of the data obtained for each block is regarded as referring to one section of that block and the above-mentioned sub-band information is regarded as referring to one section of one block. Since two adjacent blocks are shifted from each other by one section, each section in one block overlaps one section of each of successive 16 blocks, before and/or after the one block. Therefore, individual sub-band information relating to the same section are obtained from successive 16 blocks. The above reference to "the synthesis of successive 16 waveforms" means to synthesizing data obtained from the successive 16 blocks referring to one section.

FIG. 4 is a block diagram showing the construction of a part of the conventional sound signal decoder for performing the decoding of a compressed sound signal in the above-mentioned manner. FIG. 5 is a flow chart showing the operation of the sound signal decoder shown in FIG. 4.

In the sound signal decoder shown in FIG. 4, reference numeral 31 denotes an input unit. The input unit 31 extracts quantization levels (Allocation), scale factors (SF) and quantization data (Sample) for each sub-band from an input or a data stream Ds of compressed sound signal inclusive of various data as shown in FIG. 3 by use of a separation and extraction circuit 31*a* which is provided in the input unit 31. This processing is performed in accordance with control by an input controller 32.

Numeral 33 denotes an inverse quantization unit which performs the processings as mentioned below in accordance with the control of an inverse quantization controller 37. Namely, the inverse quantization unit 33 performs an inverse quantization processing and an inverse scaling processing by use of an inverse quantization processing unit 34 and a first multiplier 35 which are provided in the inverse quantization unit 33.

The inverse quantization processing unit 34 determines the operation value Sample-Value by applying to the quantization data (Sample) an inverse quantizing operation as shown by equation (1) by using the quantization levels as extracted. Namely, provided that the number of bits of quantization data (Sample) included in one sub-band indicated by the value of the quantization level is nb which is in a range of 2 to 15 and the value of the quantization data (Sample) is S which is in a range of 0 to $2^{nb-1}$, the operation value Sample-Value of normalized sample data corresponding to the quantization data is determined from the following equation:

$$\left.\begin{aligned} S'' &= \frac{S - 2^{nb-1}}{2^{nb-1}} \\ \text{Sample-Value} &= \frac{2^{nb}}{2^{nb}-1}\,(S'' + 2^{-nb+1}). \end{aligned}\right\} \quad (1)$$

The operation value Sample-Value determined by the inverse quantization processing unit 34 is multiplied by the value of $2^{1-SF/3}$ in the first multiplier 35 by the use of the above-mentioned scale factor (SF) to determine sub-band information Sj, j being in a range of 0 to 31 and indicating the sub-band number of each of 32 sub-bands.

As the value of $2^{1-SF/3}$ is used a value SF-TBL (Scale-Factor) which is stored beforehand as table information in a first table ROM 36. A difference of the table information SF-TBL (Scale-Factor) from the value of $2^{1-SF/3}$ actually calculated on the basis of a given scale factor (SF) is within a rounding error. In the MPEG-Audio standard, therefore, values are given in the form of a table of numeric values.

As mentioned above, the scale factor (SF) is indicated by 6 bits. Therefore, the value of scale factor (SF) is an integer in the range of 0 to 63 (in which 0 to 62 are effective values and 63 is an error). Accordingly, the first table ROM 36 requires a storage capacity for at least 63 words.

Reference numeral 38 denotes a buffer unit. The sub-band information Sj determined by the inverse quantization unit 33 is stored in a first buffer memory (RAM) 39 included in the buffer unit 38. The sub-band information Sj stored in the first buffer memory (RAM) 39 is used when a synthesis processing is performed in the next stage.

In order to keep the accuracy of inverse quantizing operation at a level higher than a predetermined fixed level, about 16 bits are required as the number of bits of the sub-band information Sj obtained by the operation. Accordingly, the first buffer memory 39 requires a storage capacity of at least 6144 bits, i.e. 32 (sub-bands)×12 (samples)×16 bits.

The sub-band information Sj stored in the first buffer memory 39 is supplied to a synthesis unit 41 in the next stage in accordance with a buffer memory controller 40. The synthesis unit 41 is provided with a second multiplier 42, a cumulative adder 43 and a second table ROM 44 by which waveform information Vi (i=0~63) is determined from the frequency of each sub-band and the phase of a time of the waveform information Vi to be determined.

More particularly, the sub-band information Sj supplied from the first buffer memory 39 is multiplied in the second multiplier 42 by the value of $\cos((16+i)\times(2j+1)\pi/64)$. The value of $\cos((16+i)\times(2j+1)\pi/64)$ is stored beforehand as table information in the second ROM 44. The parameter i in the cosine function is a parameter in the direction of time axis (or a sample number) and takes a value in a range of 0 to 63. The parameter j therein is a parameter in the direction of frequency axis (or a sub-band number) and takes a value in a range of 0 to 31.

Next, the values of multiplication products obtained by the second multiplier 42 for respective sub-bands are all added by the cumulative adder 43 to determine waveform operational Vi. A series of operational processings by the synthesis unit 41 are performed in accordance with control by a synthesis controller 45.

Now consider the storage capacity of the second table ROM 44 in which the values of the abovementioned cosine function are stored. Since a cosine function has as one feature a periodicity as shown by the following equation (2), it is sufficient to prepare 128 values of 0 to 127 for the value of $(16+i)\times(2j+1)$ in the expression representing the above-mentioned cosine function:

$$\cos(x)=\cos(2\pi n+x),\ n=\text{integer} \quad (2)$$

Also, since the cosine function has as another feature a symmetry as shown by the following equations (3) and (4), it is sufficient to prepare 32 values of 0 to 31 which is one fourth of the range of 0 to 127 for the value of $(16+i)\times(2j+1)$:

$$\cos(x)=\cos(2\pi-x),\ x=\pi\sim 2\pi \quad (3)$$

$$\cos(x)=-\cos(\pi-x),\ x=\pi/2\sim\pi \quad (4)$$

Consequently, it is necessary to prepare 32 values of 0 to 31 for the value of $(16+i)\times(2j+1)$ of the expression $\cos((16+i)\times(2j+1)\pi/64)$. Accordingly, the second table ROM 44 requires a storage capacity of at least 32 words.

Reference numeral 46 denotes an output unit. The waveform information Vi determined by the synthesis unit 41 is stored in a second buffer memory 47 included in the output unit 46. The second buffer memory 47 requires a storage capacity of 1024 bits (=64×16 bits) for each sample.

Next, the operation of the sound signal decoder having the above construction will be explained with reference to the block diagram shown in FIG. 4 and a flow chart shown in FIG. 5.

In step P1 shown in FIG. 5, a quantization level (Allocation), a scale factor (SF) and quantization data (Sample) are extracted by the separation and extraction circuit 31*a* from a data stream Ds of compressed sound signal.

The extracted quantization level (Allocation) and quantization data (Sample) are supplied to the inverse quantization processing unit 34. On the other hand, the scale factor (SF) is supplied to the first table ROM 36.

Next, in step P2, the quantization data (Sample) is subjected to inverse quantization by the inverse quantization processing unit 34 in accordance with the quantization level (Allocation) to determine the operation value Sample-Value. The determined operation value Sample-Value is supplied to the first multiplier 35. In the first multiplier 35, the operation value Sample-Value is multiplied by the value of SF-TBL (Scale-Factor) read from the first table ROM 36 corresponding to the value of the scale factor (SF) to determine sub-band information Sj.

In step P3, the determined sub-band information Sj is temporally stored into the first buffer memory 39. In step P4, the multiplier 42 multiplies the sub-band information Sj supplied from the first buffer memory 39 by the value of $\cos((16+i)\times(2j+1)\pi/64)$. The thus obtained values of multiplication products for respective sub-bands are all added by the cumulative adder 43 to determine waveform information Vi.

In step P5, the determined waveform information Vi is stored into the second buffer memory 47. Thereafter, the waveform information Vi stored in the second buffer memory 47 is outputted to a sub-band filter (not shown) in accordance with control by an output controller 48 in order that it is used in an up-sampling process in the sub-band filter.

As above-mentioned, the conventional decoder for the sound signal of the MPEG standard requires a memory having a large capacity in the process for obtaining the synthesis information from a data stream of compressed sound signal.

Namely, since the conventional decoder for the sound signal of the MPEG standard has the inverse quantization unit 33 and the synthesis unit 41 separately, it is necessary to provide the first buffer memory 39 between the inverse quantization unit 33 and the synthesis unit 41 in order to use the sub-band information Sj determined by the inverse quantization unit 33 in the synthesis unit 41.

It is also necessary that each of the inverse quantization unit 33 and the synthesis unit 41 has the table ROM in which multiplier factors required for an operational processing by the unit 33 or 41 are stored beforehand. Accordingly, there is the problem that both the number of memories to be used and the memory capacity become large, resulting in complicating the hardware construction of the apparatus.

Further, since the multiplication processing having a large load of operation must be performed two times repectively in the inverse quantization unit 33 and the synthesis unit 41 before obtaining the synthesis information, there is the problem that the load of operation becomes very large as a whole, resulting in a longer processing time.

SUMMARY OF THE INVENTION

An object of the present invention is to solve the above-mentioned various problems of the prior art and provide an apparatus for decoding compressed and coded sound signal in which the number of required memories is reduced, a required memory capacity is reduced, and the load of operation is small.

To that end, the apparatus of the present invention for decoding a compressed and coded sound signal by applying thereto an inverse quantization processing, and a synthesis processing comprises data extracting means for extracting quantization level data, scale factor data and quantization data from a data stream of the compressed and coded sound signal, and integrated processing means for processing the extracted data by use of a third operational equation which is obtained by combining a first operational equation used for the inverse quantization processing with a second operational equation used for the synthesis processing.

In a preferred embodiment of the present invention, the third operation equation is represented by a multiplicational product of a first term which represents a value determined as a function of the quantization level data and the quantization data and a second term which is represented by an exponential function having an exponent of a value specified by the scale factor data and the integrated processing means includes: (a) storing means for storing as a table the values of the exponential function corresponding to all possible values of a fraction part of the exponent; (b) separating means for separating the exponent specified by the extracted scale factor data into an integer part and the fraction part; (c) first operational processing means for determining a first operation value represented by a multiplication product of the value of the exponential function which is read from the storing means corresponding to the value of the fractional part separated by the separating means and the value of the first term corresponding to the extracted quantization level and quantization data; (d) and second operational processing means for determining a second operation value by applying to the first operation value shift operation on the basis of the value of the integer part separated by the separating means.

In the prior art, the inverse quantization processing and the synthesis processing are separately performed by using the first operational equation and the second operational equation, respectively. Therefore, the buffer memory for temporally storing the intermediate value of calculation obtained by the inverse quantization processing is required between the inverse quantization processing and the synthesis processing. In the present invention, however, since the inverse quantization processing and the synthesis processing are performed in an integrated manner by use of the third operational equation, the buffer memory for temporal storage is not required.

In the preferred embodiment of the present invention, the exponent specified by the scale factor is separated into the integer part and the fraction part. An operational processing for the second term of the third operational equation relating to the fraction part is performed by using the storing means in which all possible values of the fraction part and the corresponding values of the exponential function are stored in the form of a table, whereas a processing for the second term of the third operational equation relating to the integer part is performed by the shift operation. As a result the operation is greatly simplified, thereby making it possible to reduce the memory capacity required for the operation.

DESCRIPTION OF THE PREFERRED EMBODIMENTS

An embodiment of the present invention will now be described with reference to the accompanying drawings.

Figure 1:
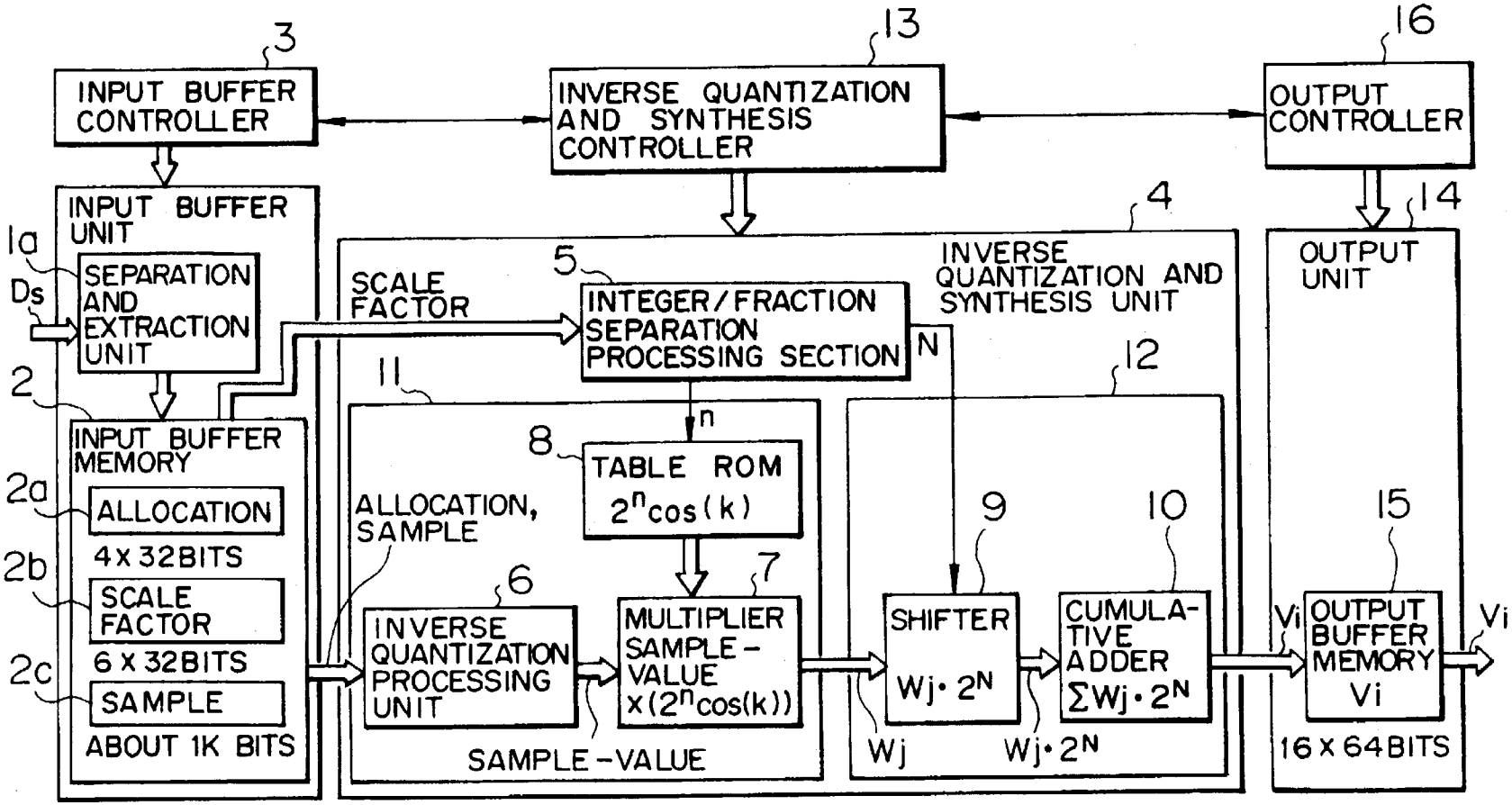
FIG. 1 is a block diagram showing the circuit construction of a compressed and coded sound signal decoding apparatus according to an embodiment of the present invention.
Figure 2:
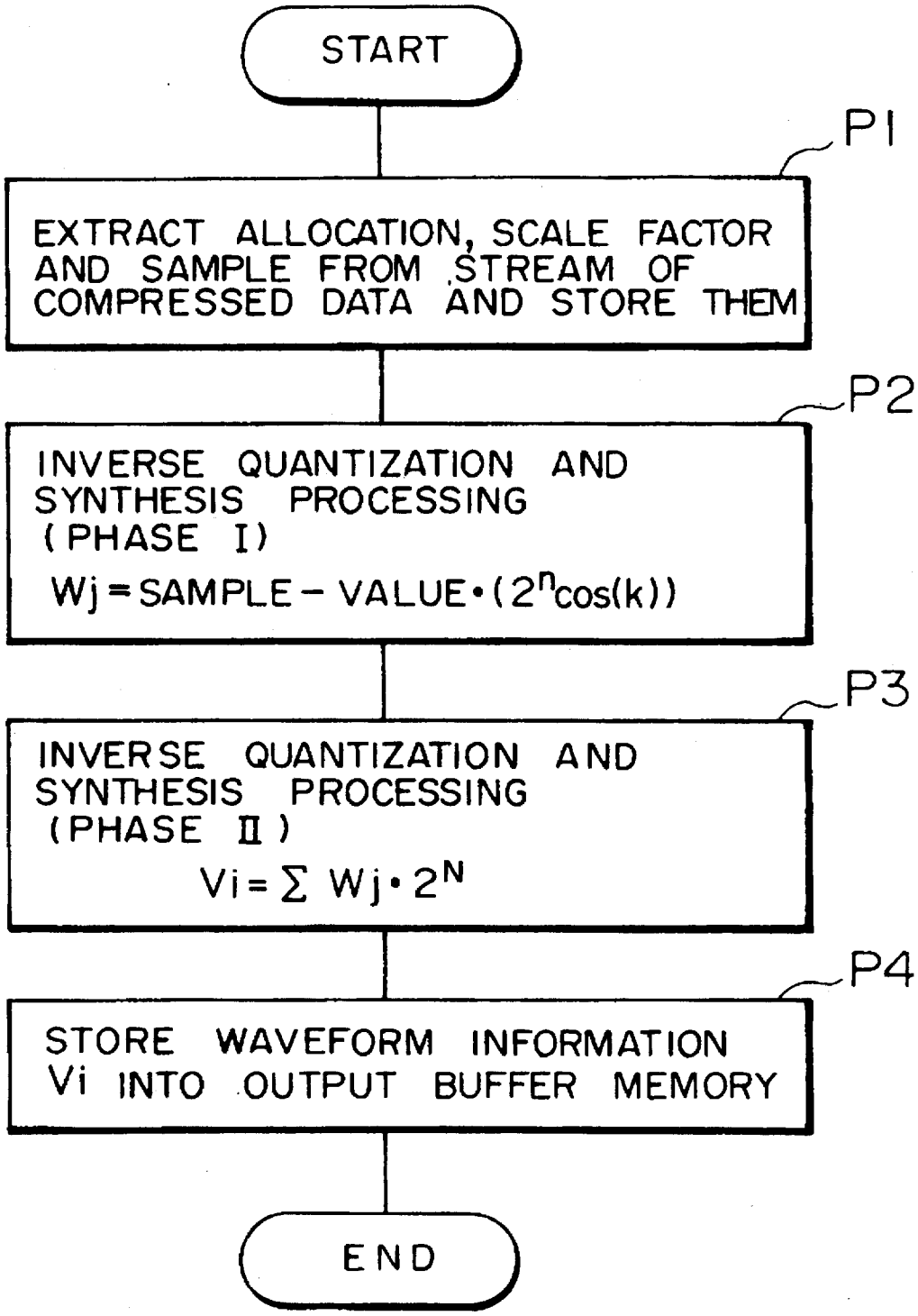
FIG. 2 is a flow chart showing the operation of the decoding apparatus shown in FIG. 1.
Figure 3:
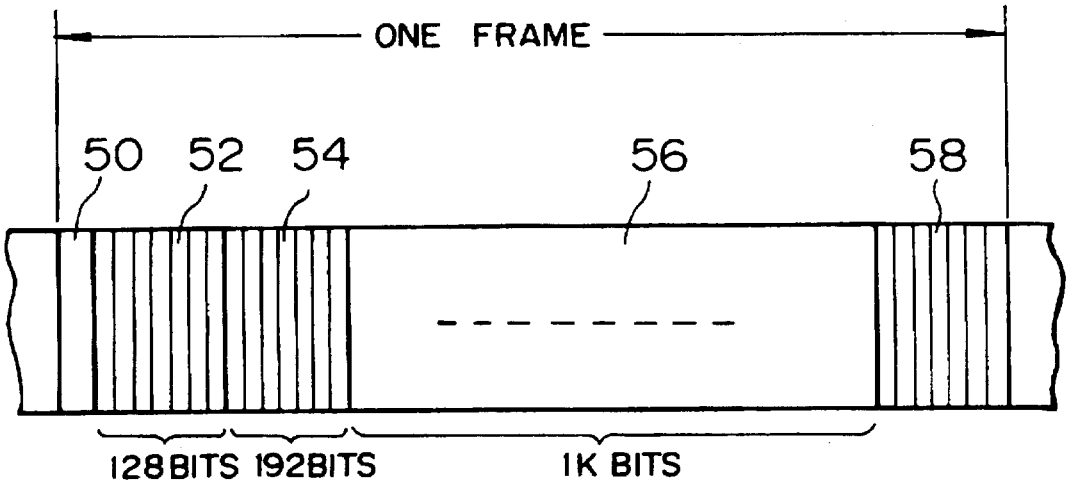
FIG. 3 shows an example of the format of a data stream representing a compressed and coded sound signal.

FIG. 1 is a block diagram schematically showing the construction of a part of a sound signal decoder according to an embodiment of the present invention. FIG. 2 is a flow chart showing the operation of the sound signal decoder shown in FIG. 1.

In FIG. 1, reference numeral 1 denotes an input buffer unit which is provided with a separation and extraction circuit la and an input buffer memory 2. The separation and extraction circuit 1*a* separately extracts quantization level (Allocation), scale factors (SF) and quantization data (Sample) from an inputted data stream Ds of a compressed sound signal.

The respective data extracted by the separation and extraction circuit 1*a* are stored into predetermined areas of the input buffer memory 2 or an Allocation storage area 2*a*, a Scale Factor storage area 2*b* and a Sample storage area 2*c*. The above processing in the input buffer unit 1 is performed in accordance with control by an input buffer controller 3.

As has been mentioned in conjunction with the prior art, the quantization level (Allocation), scale factor (SF), and quantization data (Sample) have respective data amounts of 128 bits, 192 bits and about 1 Kbits for one frame under the conditions of the layer 1, the single-channel mode, the transmission rate of 128 Kbit/sec and the sampling rate of 48 KHz. Accordingly, the input buffer memory 2 for storing those data needs to have a total storage capacity of about 1300 bits.

Reference numeral 4 denotes an inverse quantization and synthesis unit. An inverse quantization and synthesis processing is performed by circuits included in the inverse quantization and synthesis unit 4 to determine waveform information Vi. Namely, in the present embodiment, the inverse quantization processing and the synthesis processing which are performed separately in the conventional decoder, are performed here in an integrated or combined manner by use of the inverse quantization and synthesis unit 4, thereby implementing the reduction of the capacity of the buffer memory, the reduction of the load of operation and the reduction of the number of table ROM's to be used.

The principle of integrating the inverse quantizing operation and the synthesizing operation will now be mentioned.

In the conventional sound signal decoder, an inverse quantizing operation as shown by equation (5) is performed to determine sub-band information Sj and a synthesizing operation as shown by equation (6) is performed by use of the sub-band information Sj to determine waveform information Vi:

$$Sj=\text{Sample-Value}\times 2^{1-SF/3} \tag{5}$$

$$Vi=\Sigma Sj\cos((16+i)\times(2j+1)\pi/64) \tag{6}$$

On the other hand, equations (5) and (6) can be combined or integrated into one equation as shown by equation (7):

$$Vi=\Sigma\text{Sample-Value}\times 2^{1-SF/3}\times\cos(k) \tag{7}$$

where $k=(16+i)\times(2j+1)\pi/64$ for simplicity.

When the value of 1−SF/3 representing an exponent in equation (7) is separated into an integer part N and a fraction part n, the following equation stands:

$$N+n=1-SF/3. \tag{8}$$

Since the possible values of the scale factor (SF) is in a range of 0 to 63, as mentioned above, the range of values of N and n, are N=−20~1 and n=0, ⅓ and ⅔, respectively. Further, a modified version of the equation (8) by applying thereto the equation (7) provides the following equation (9):

$$\begin{aligned} Vi &= \Sigma\,\text{Sample-Value}\times 2^{(N+n)}\times\cos(k) \\ &= \Sigma\,\text{Sample-Value}\times 2^{N}\times 2^{n}\times\cos(k) \\ &= \Sigma\, 2^{N}\times\text{Sample-Value}\times 2^{n}\times\cos(k). \end{aligned} \tag{9}$$

In the inverse quantization and synthesis unit 4 of the present embodiment, an operation shown by equation (9) is processed by separate operations of an operation relating to the fraction part n and an operation relating to the integer part N, as shown by equation (10):

$$\left.\begin{aligned} Wj &= \text{Sample-Value} \times (2^n\cos(k)) \\ Vi &= \Sigma\, Wj \times 2^N. \end{aligned}\right\} \quad (10)$$

Namely, in the present embodiment, the value of 1−SF/3 is separated by an integer/fraction separation processing section 5 into an integer part N and a fraction part n. First operational processing means 11 determines the intermediate operation value Wj in accordance with the value of the fraction part n. Further, second operational processing means 12 determines waveform information Vi by use of the intermediate operation value Wj in accordance with the value of the integer part N.

An inverse quantization processing unit 6, which is one of the components of the first operational processing means 11, is provided for determining the operation value Sample-Value by applying to the quantization data (Sample) an inverse quantizing operation as shown by equation (1) by use of the quantization level (Allocation) supplied from the input buffer memory 2.

A multiplier 7, which is another component of the first operational processing means 11, is provided for multiplying the operation value Sample-Value determined by the inverse quantization processing unit 6 by $2^n\cos(k)$ ($k=(16+i)\times(2j+1)\pi/64$, (i=0~63 and j=0~31) to determine the intermediate operation value Wj. A table ROM 8, which is a further component of the first operational processing means 11, is provided for storing as table information the values of $2^n\cos(k)$ beforehand calculated in accordance with the values of i, j and n. When the value of the fraction part n is supplied to the table ROM 8 from the integer/fraction separation processing section 5, the corresponding value of $2^n\cos(k)$ is outputted from the table ROM 8 for each sub-band and supplied to the multiplier 7.

Now consider the storage capacity of the table ROM 8 in which the values of $2^n\cos(k)$ are stored. For $k=(16+i)\times(2j+1)\pi/64$ which is a factor of cos(k), it is sufficient to prepares 32 values of 0 to 31, as has been mentioned in conjunction with the prior art. On the other hand, 3 values of n=0, ⅓ and ⅔ are necessary for the exponent of $2^n$. Accordingly, 96 (=32×3) values are required for the whole possible values of $2^n\cos(k)$ and the table ROM 8 requires a storage capacity of 96 words.

In conventional sound signal decoders, on the other hand, the storage capacity of the first table ROM 36 is 63 words and the storage capacity of the second table ROM 44 is 32 words. Accordingly, the total storage capacity amounts to 95 (=63+32) words which is slightly smaller than that in the case of the present embodiment. However, the present embodiment has merit in that it is sufficient to provide only one ROM and hence the hardware construction of the apparatus can be simplified.

A shifter 9, which is one of the components of the second operational processing means 12, is provided for receiving the value of the integer part N outputted from the integer/fraction separation processing section 5 to perform a shift operation by $2^N$ for the intermediate operation value Wj determined by the first operational processing means 11. A cumulative adder 10, which is another component of the second operational processing means 12, is provided for adding all the values obtained by shift operation for respective sub-bands determined by the shifter 9 to determine waveform information Vi.

An inverse quantization and synthesis controller 13 is provided for controlling the above-mentioned series operational processings in the inverse quantization and synthesis unit 4. An output unit 14 includes an output buffer memory 15 in which the values of waveform information Vi determined by the inverse quantization and synthesis unit 4 are stored. The values of waveform information Vi stored in the output buffer memory 15 are supplied to a polyphase filter (not shown) in accordance with control by an output controller 16.

Next, the operation of the sound signal decoder of the present embodiment having the above construction will be explained by using the block diagram shown in FIG. 1 and the flow chart shown in FIG. 2.

In step P1 shown in FIG. 2, a quantization level (Allocation), a scale factor (SF) and quantization data (Sample) are extracted by the separation and extraction circuit 1*a* from a data stream Ds of compressed sound signal and are stored into the predetermined areas 2*a*, 2*b* and 2*c* of the input buffer memory 2, respectively.

The quantization level (Allocation) and the quantization data (Sample) stored in the input buffer memory 2 are supplied to the inverse quantization processing unit 6, and the scale factor (SF) is supplied to the integer/fraction separation processing section 5.

Next, in step P2, the quantization data (Sample) is subjected to an inverse quantizing operation by the inverse quantization processing unit 6 in accordance with the quantization level (Allocation) to determine the value of operation Sample-Value. The determined value of operation Sample-Value is supplied to the multiplier 7.

On the other hand, an exponent of $2^{1-SF/3}$ specified by the value of the scale factor (SF) is separated by the integer/fraction separation processing section 5 into an integer part N and a fraction part n. The value of the fraction part n is supplied to the table ROM 8. The corresponding value of $2^n\cos(k)$ is read from the table ROM 8 in accordance with the value of the fraction part n and supplied to the multiplier 7. Thereby, the multiplier 7 multiplies the operation value Sample-Value supplied from the inverse quantization processing unit 6 by the value of $2^n\cos(k)$ supplied from the table ROM 8 to determine the intermediate operation value Wj for each sub-band.

In step P3, the intermediate operation value Wj determined by the inverse quantization processing unit 6 and the multiplier 7 is shifted in the shifter 9 by $2^N$ on the basis of the value of the integer part N supplied from the integer/fraction separation processing section 5. Next, the thus obtained shift operation values for the respective sub-bands are all added by the cumulative adder 10 to determine waveform information Vi.

In step P4, the determined waveform information Vi is stored into the output buffer memory 15 in order to use it in an up-sampling process in a sub-band filter (not shown).

Figure 4:
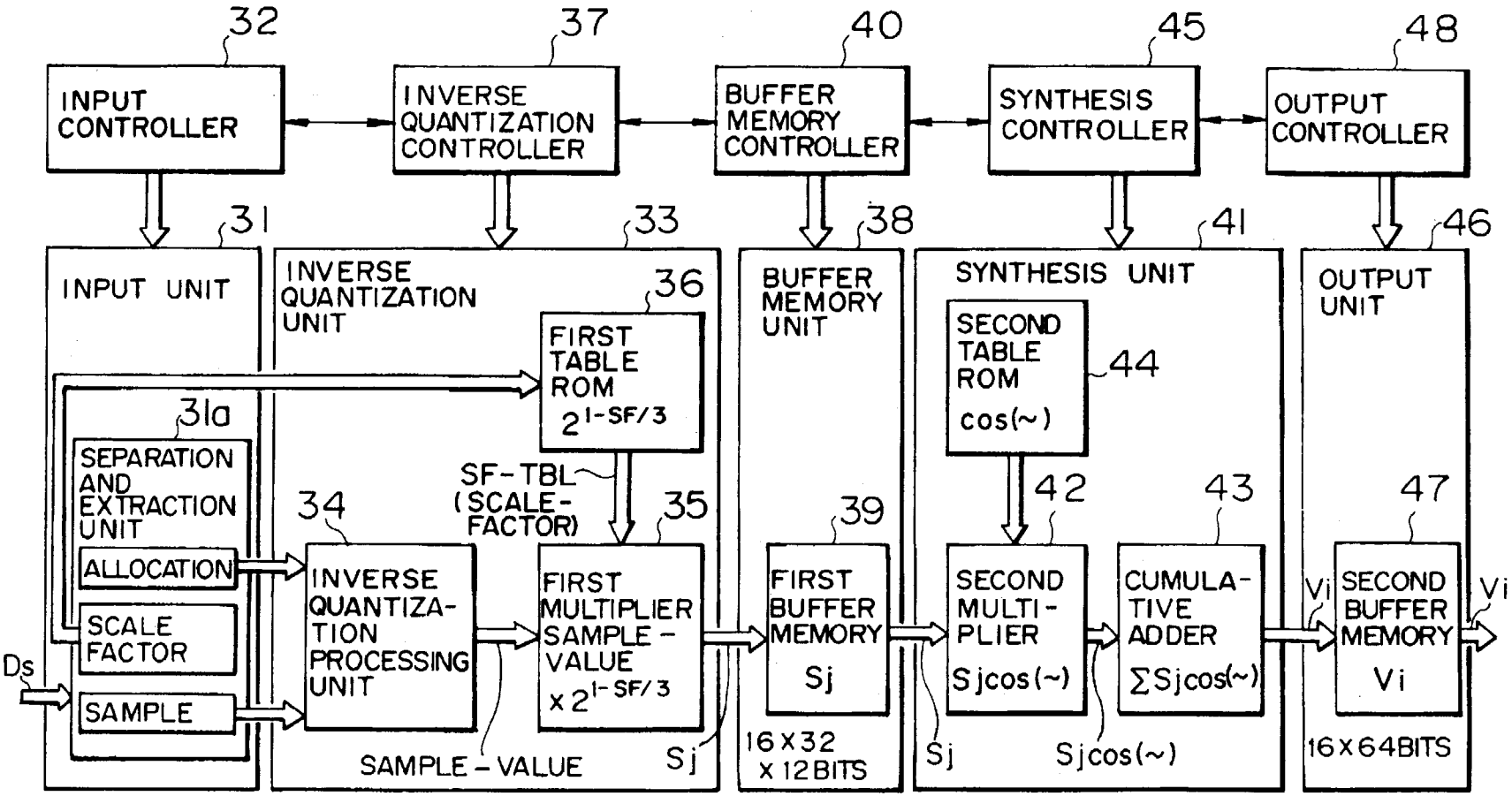
FIG. 4 PRIOR ART
FIG. 4 is a block diagram showing the circuit construction of the conventional compressed and coded sound signal decoding apparatus.
Figure 5:
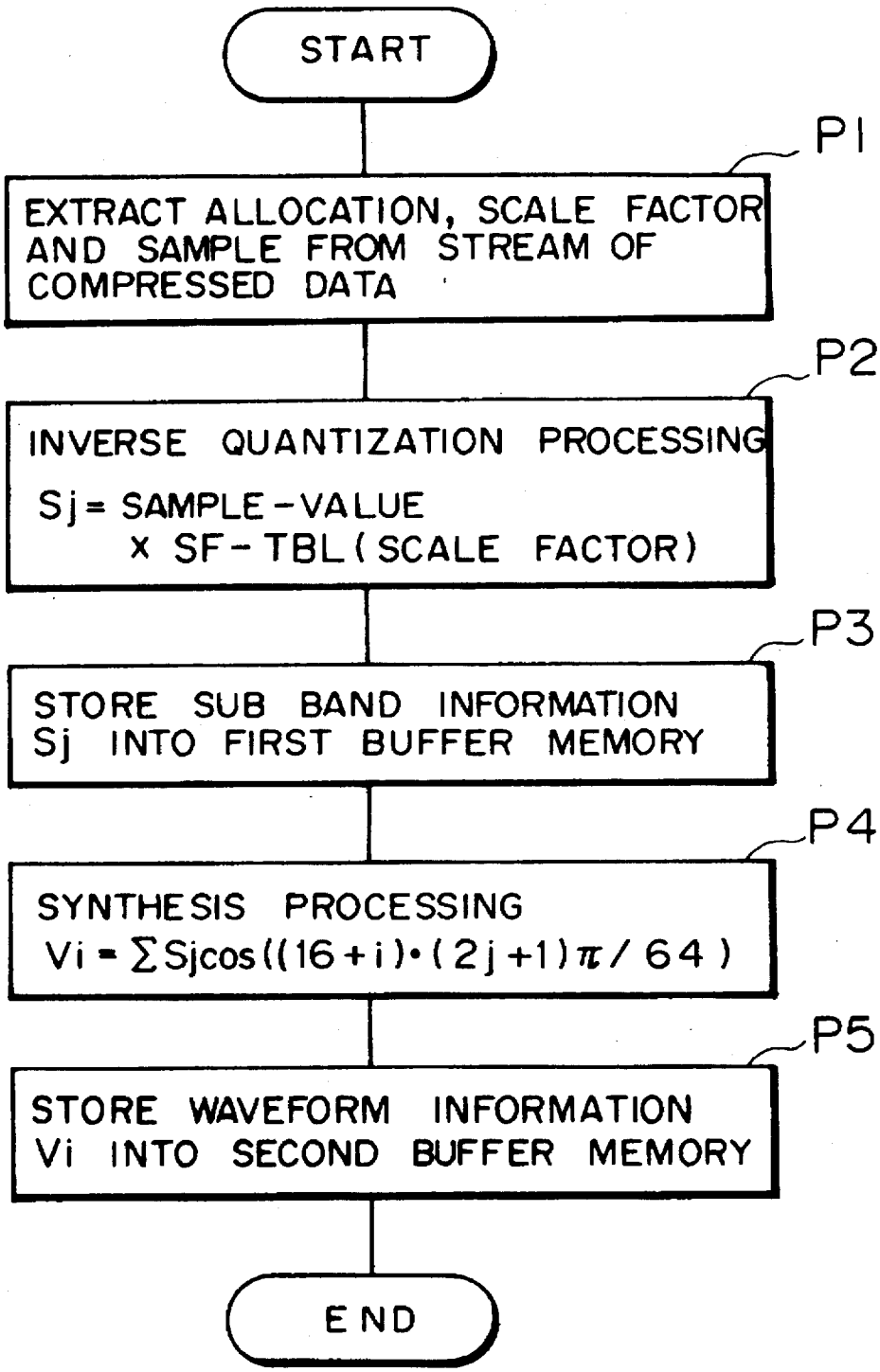
FIG. 5 PRIOR ART
FIG. 5 is a flow chart showing the operation of the conventional decoding apparatus shown in FIG. 4.

In the decoder of the present embodiment for decoding the sound signal encoded by the MPEG standard as mentioned above, the inverse quantizing operation and the synthesizing operation, which are separately performed in the conventional sound signal decoder, are performed here in an integrated manner in accordance with a predetermined rule. In contrast with the conventional decoders, therefore, it is not required in the present embodiment to provide the first buffer memory 39 as shown in the block diagram of FIG. 4 at a preceding stage of the circuit for performing the synthesis processing.

Namely, the conventional decoder for decoding the sound signal encoded by the MPEG standard requires the first buffer memory 39 having a storage capacity of 6144 bits whereas the decoder of the present embodiment for decoding the MPEG encoded sound signal has no need to provide a buffer memory having such a large storage capacity.

Though the decoder of the present embodiment for decoding the MPEG encoded sound signal needs to provide the input buffer memory 2 for storage of quantization level (Allocation), scale factor (SF) and quantization data (Sample) at a preceding stage of the inverse quantization and synthesis unit 4, it is sufficient to provide about 1300 bits of the storage capacity for the input buffer memory 2. In the present embodiment, therefore, it is possible to reduce the storage capacity of the buffer memory to about 20% of that in the conventional sound signal decoder.

In the present embodiment, an operational processing based on the integrated operational equation shown by equation (9) is performed by separate processings of an operational processing referring to an integer part N and an operational processing referring to a fraction part n, as shown by equation (10). Accordingly, it is possible to determine waveform information Vi by merely performing an operation based on a multiplication operation for the fractional part n and a shift operation for the integer part N.

The load of shift operation is smaller than that of multiplication operation, is well known. According to the present embodiment, therefore, the load of operation for decoding can be made considerably smaller as compared with that in the prior art in which the multiplication having a large load of operation must be performed two times.

Further, the shift operation has no need to prepare, as table information, complicated multiplication values beforehand calculated which are required in the case of the multiplication operation. Therefore, it is not necessary to provide an additional table ROM for shift operation. Accordingly, the number of ROM's to be used can be reduced from two in the case of the prior art to one, thereby to simplifying the hardware construction.

The foregoing explanation has been made based on layer 1 of the MPEG standard. However, it is needless to say that the present invention is also applicable to the layer 2 or the layer 3. For example, the case of the layer 2, the number of channels=2 (dual-channel or stereophonic), the transmission rate of 384 Kbit/sec and the sampling rate of 48 KHz will now be considered.

The layer 2 is basically the same as the layer 1 but differs in that the number of sound samples included in one frame, which is the unit in processing, is increased to improve the efficiency of compression. Namely, the number of samples in the layer 2 is 1152 or three times as large as that in the layer 1. Accordingly, in the conventional decoder for decoding the MPEG encoded sound signal, the first buffer memory 39 shown in FIG. 4 requires a storage capacity of 36864 bits, i.e. 1152 (samples)×2 (channels)×16 bits.

In layer 2, on the other hand, the required numbers of bits per one frame for the quantization levels (Allocation), scale factors (SF) and quantization data (Sample) are 384 bits of 3×32 sub-bands×4 bits, 576 bits of 3×32 sub-bands×6 bits and 9216 bits of 384K/48K×1152, respectively.

Accordingly, in the decoder of the present embodiment for decoding the MPEG encoded sound signal, a storage capacity of 10176 bits is sufficient for the input buffer memory 2 for storage of the above-mentioned data. According to the present embodiment, therefore, it is possible to reduce the storage capacity of the buffer memory to about 27.6% of that in conventional sound signal decoders.

In the present invention as mentioned above, since operational equations used for obtaining the synthesis information from a data stream of compressed sound signal are integrated or modified into one equation so that an inverse quantization processing and a synthesis processing are performed in an integrated manner on the basis of the integrated operational equation, it is possible to perform the inverse quantization processing and the synthesis processing by one operational processing circuit group. Therefore, it is possible to eliminate a buffer memory which the conventional sound signal decoder needs between the inverse quantization processing circuit and the synthesis processing circuit. Thereby, it is possible to greatly reduce a memory capacity necessary for decoding.

According to another feature of the present invention, an operational processing based on the integrated operational equation is performed by separating it into an operational processing referring to an integer part and an operational processing referring to a fraction part. Therefore, synthesis information can be determined through only one multiplication operation and one shift operation. Thereby, it is possible to considerably reduce the load of operation for decoding because one of the two multiplication operations in the prior art is substituted by one shift operation in the present invention. As a result, it is possible to shorten the processing time for decoding. Further, since the number of circuits for performing the multiplicational operation can be reduced, as mentioned, it is possible to reduce the number of memory means in which complicated multiplication values used for the multiplication operation are stored as table information beforehand, resulting in the simplified construction of the apparatus.

I claim:

1. An apparatus for decoding a compressed and coded sound signal, comprising:

data extracting means for extracting quantization level data, scaler factor data and quantization data from a data stream of compressed and coded sound signal; and integrated processing means for processing the extracted data by use of an integrated operational equation which is obtained from the combination of a first operational equation used for an inverse quantization processing and a second operational equation used for a synthesis processing, said integrated operation equation being represented by a multiplicational product of a first term which represents a value determined as a function of said quantization level data and said quantization data and a second term which is represented by an exponential function having an exponent of a value specified by said scale factor data; and wherein said integrated processing means includes:

storing means for storing as a table, values of said exponential function corresponding to all possible values of a fraction part of said exponent;

separating means for separating said exponent specified by the extracted scale factor data into an integer part and the fraction part;

first operational processing means for determining a first operation value represented by a multiplication product of the value of said exponential function which is read from said storing means corresponding to a value of said fractional part separated by said separating means and a value of said first term which corresponds to the extracted quantization level and quantization data; and second operational processing means for determining a second operation value by applying to said first operation value shift operation on the basis of a value of said integer part separated by said separating means.

2. An apparatus according to claim 1, wherein said storing means stores data values of a multiplication product of the values of said exponential function corresponding to all possible values of a fraction of said exponent and values of a predetermined cosine function.

3. An apparatus according to claim 1, further comprising means for cumulatively adding the second operation values obtained by said second operational processing means, respectively, based on values of said integer part.

* * * * *